US007789617B2

(12) United States Patent
Wahl et al.

(10) Patent No.: US 7,789,617 B2
(45) Date of Patent: Sep. 7, 2010

(54) IMPELLER AND DIFFUSER WITH A ROTATING AND CONVERGING HUB

(75) Inventors: Fabien Wahl, Saint Marcel (FR); Jean-Michel Nguyen Duc, Vezillon (FR); Fabien Tessier, Vernon (FR); Sebastien Boufflert, Louviers (FR)

(73) Assignee: SNECMA, Paris (FR)

( * ) Notice: Subject to any disclaimer, the term of this patent is extended or adjusted under 35 U.S.C. 154(b) by 365 days.

(21) Appl. No.: 11/580,158

(22) Filed: Oct. 13, 2006

(65) Prior Publication Data

US 2008/0080973 A1 Apr. 3, 2008

(30) Foreign Application Priority Data

Sep. 28, 2006 (FR) ..... 06 53985

(51) Int. Cl.
*F04D 29/44* (2006.01)

(52) U.S. Cl. ..... 415/143; 415/199.6; 415/218.1; 415/219.1; 415/221; 415/222; 415/208.2; 415/211.2; 416/175; 416/201 A; 416/203

(58) Field of Classification Search ..... 415/143, 415/186–188, 199.6, 218.1, 219.1, 220–223, 415/208.2, 208.3, 208.5, 211.2; 416/175, 416/203, 198 R, 201 A
See application file for complete search history.

(56) References Cited

U.S. PATENT DOCUMENTS 2,947,468 A * 8/1960 Tryon ..... 415/218.1
3,826,594 A * 7/1974 Hornschuch et al. ..... 415/143

FOREIGN PATENT DOCUMENTS

DE 198 29 810 A1 1/1999
DE 198 58 700 A1 6/1999
GB 2 202 585 A 9/1988

* cited by examiner

*Primary Examiner*—Christopher Verdier
(74) *Attorney, Agent, or Firm*—Oblon, Spivak, McClelland, Maier & Neustadt, L.L.P.

(57) ABSTRACT

A suction stage for a pump with a centrifugal wheel, the suction stage including a rotational impeller equipped with a hub and arranged upstream of the centrifugal wheel, the suction stage further including a diffuser arranged between the impeller and the centrifugal wheel, the diffuser including a plurality of blades. The hub has a downstream surface extending axially so as to converge toward the centrifugal wheel, and the blades of the diffuser have free ends, the blades protruding radially toward the downstream surface.

11 Claims, 1 Drawing Sheet

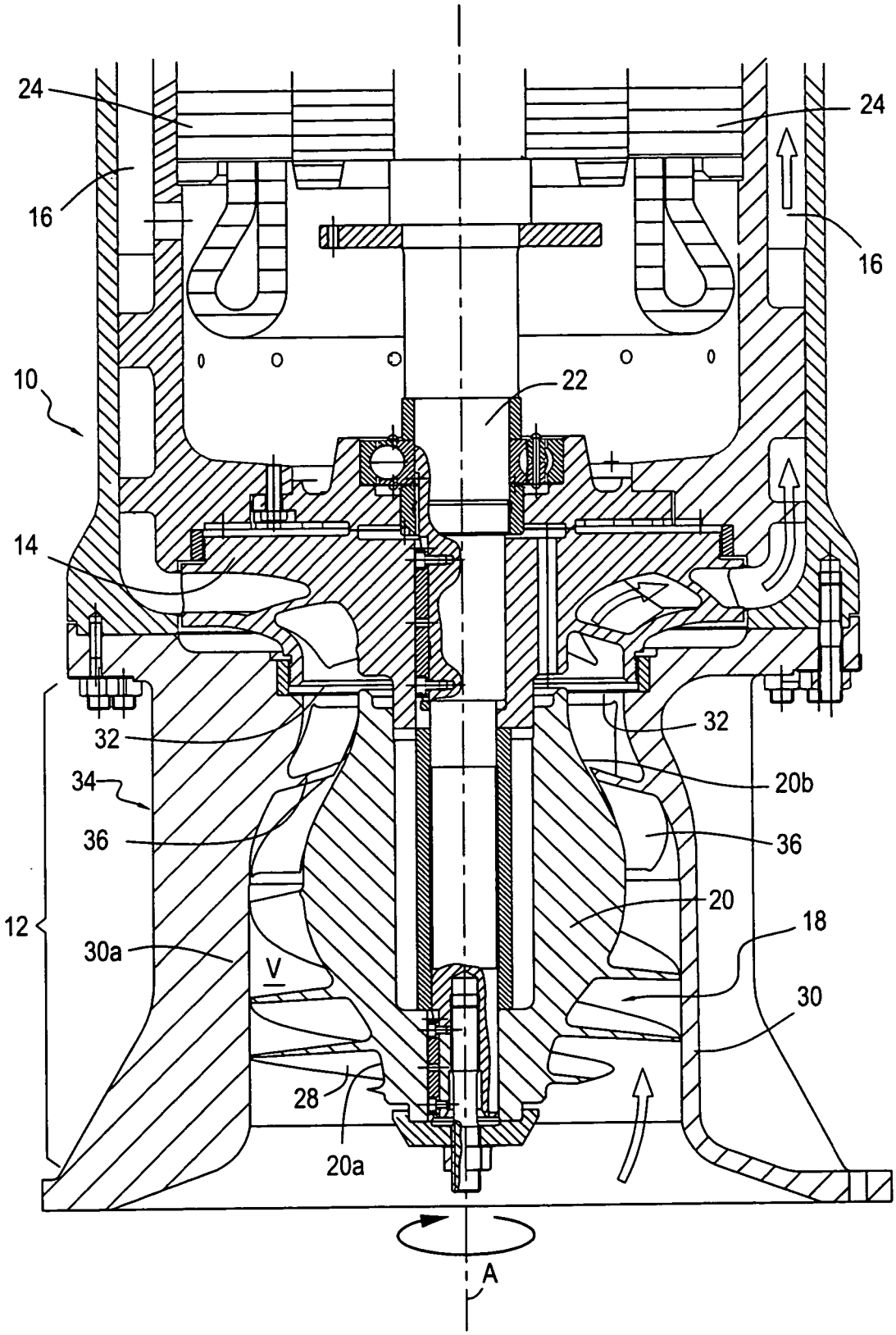
24
24
16
16
10
22
14
32
32
34
20b
36
36
12
20
18
30a
V
30
28
20a
A

IMPELLER AND DIFFUSER WITH A ROTATING AND CONVERGING HUB

The present invention relates to the field of pumps such as, for example, pumps intended to draw in liquefied gas, said pumps generally comprising a centrifugal wheel.

The present invention relates, more specifically, to a suction stage for a pump having at least one centrifugal wheel, the suction stage comprising a rotational impeller equipped with a hub and arranged upstream of the centrifugal wheel, the suction stage further comprising a diffuser arranged between the impeller and the centrifugal wheel, the diffuser comprising a plurality of blades.

A centrifugal-wheel pump of this type is already known.

Viewed in the direction in which the fluid is drawn in, the pump with centrifugal wheel successively comprises a suction stage, the centrifugal wheel and conduits for guiding the drawn-in fluid up to the downstream end of the pump, from where it is backstreamed.

The impeller is the rotational part which is located the furthest upstream of the pump and allows the fluid to be drawn in. In a known manner, the impeller comprises paddles forming a propeller, its hub being driven in rotation by a rotational shaft fixed to the rotor of the pump motor.

Downstream of the impeller there is the diffuser, the purpose of which is to reduce the rotational component of the fluid backstreamed by the impeller before it enters the centrifugal wheel.

In previously known suction stages, the blades of the diffuser are fixed in relation to a housing of the pump and extend radially substantially up to the rotating shaft of the pump, the ends of the blades located on the side of the rotating shaft being joined to one another via a collar surrounding the rotating shaft. Also generally provided is a guide part, such as a bearing, between the collar and the rotating shaft in order to guide said shaft in rotation.

It will be appreciated that a diffuser comprising a collar of this type is complex to produce and that, in addition, the presence of a bearing makes the suction stage particularly expensive.

An object of the present invention is to provide a suction stage which is to a large extent free of the above-mentioned drawbacks.

This object is achieved in that the hub has a downstream surface extending axially so as to converge toward the centrifugal wheel, and in that the blades of the diffuser have free ends, said blades protruding radially toward said downstream surface in such a way that the free ends of the blades make said downstream surface flush.

In the sense of the present invention, the terms "upstream" and "downstream" are defined in relation to the drawing-in direction of the pump, whereas the terms "axial" and "radial" are defined in relation to the axis of rotation of the pump.

Furthermore, the term "converging surface" refers to a surface, the generatrix curve of which converges toward the axis of the pump.

It will therefore be appreciated that the hub comprises a downstream portion, the radial section of which diminishes toward the centrifugal wheel.

It should be understood that the free ends are not joined together, unlike in the prior art, so that the diffuser according to the present invention, which does not comprise a collar, is simpler and therefore less expensive to produce.

Moreover, the advantageous absence of a part for guiding the rotating shaft in the suction stage further simplifies the production thereof.

Finally, the reduction in the number of parts required to produce the suction stage makes said stage more reliable than previously known suction stages.

In the sense of the invention, the term "to make flush" refers to the fact that there is a slight clearance between each of the free ends of the blades and the downstream surface of the hub.

Preferably, each of the free ends of the blades makes the downstream surface flush over its entire length.

Advantageously, the diffuser surrounds the downstream surface of the hub of the impeller, thus improving the compactness of the suction stage.

It will therefore be appreciated that the hub of the impeller extends into the interior of the diffuser.

Advantageously, the blades of the diffuser are fixed to an outer shell which converges axially toward an inlet of the centrifugal wheel.

The fluid drawn in is thus advantageously directed as close as possible to the axis of rotation of the centrifugal wheel, thus allowing the diameter of said wheel to be reduced in order further to improve the compactness of the pump.

Preferably, the outer shell of the diffuser forms a downstream portion of an outer shell of the suction stage, said stage also having an upstream portion forming an outer shell for the impeller.

Preferably, the space located between the downstream surface of the hub and the outer shell of the diffuser defines an annular duct allowing a backstreamed fluid to pass, this annular duct having a substantially constant radial height over the entire axial length of the diffuser.

The radial extension of the blades is therefore substantially constant over the entire axial length of the diffuser.

The present invention also relates to a pump comprising a suction stage according to the present invention.

The present invention further relates to an impeller for a suction stage of a pump with centrifugal wheel, the suction stage comprising a diffuser arranged upstream of the centrifugal wheel, the diffuser comprising blades having free ends, the impeller being arranged upstream of the diffuser and comprising a hub having a downstream surface which the free ends of the blades of the diffuser are capable of making flush, said downstream surface extending axially so as to converge toward the centrifugal wheel.

Further characteristics and advantages of the invention will become clearer on reading the following description of an embodiment of the invention given by way of non-limiting example.

The description will refer to the appended FIGURE showing the upstream portion of a pump with centrifugal wheel comprising a suction stage according to the present invention.

The single FIGURE shows a pump with centrifugal wheel 14 intended preferably but not exclusively for the pumping of fluid such as liquefied gas. This pump 10 may, for example, be used for emptying the tanks of liquefied gas carriers.

In the following detailed description, the adjectives "axial" and "radial" are defined in relation to the axis of rotation A of the pump 10, whereas the adjectives "upstream" and "downstream" are defined in relation to the direction in which the fluid is drawn in.

Viewed in the drawing-in direction indicated in the present case by arrows, the pump 10 successively comprises a suction stage 12, a centrifugal wheel 14 and an annular conduit 16 allowing backstreaming of the drawn-in fluid.

The suction stage 12 according to the invention comprises a rotational impeller 18 equipped with a hub 20 which is driven in rotation by a rotating shaft 22 of the pump 10, the rotating shaft 22 being driven, for its part, by an electric motor 24 arranged downstream of the centrifugal wheel 14.

As may be seen in the FIGURE, the electric motor 24 is bordered by the backstreaming conduit 16.

It will also be noted that the rotating shaft 22 also drives the centrifugal wheel 14 in rotation.

It will be understood with reference to the FIGURE that the fluid is drawn in via the suction stage, accelerated via the centrifugal wheel 14 then guided toward the downstream portion via the backstreaming conduit 16.

The hub 20 of the impeller 18 has an outer surface comprising an upstream surface 20*a* extending toward the upstream portion of the pump 10 so as to converge and also a downstream surface 20*b* advantageously extending so as to converge toward the centrifugal wheel 14 in such a way that the hub 20 has a greater diameter in its median portion than at its ends.

The term "converging surface" refers to the fact that the generatrix of this surface tends to draw closer to the axis A of the pump.

As shown in the FIGURE, the upstream surface 20*a* of the hub carries paddles 28 extending radially toward an outer shell 30 surrounding the hub 20, whereas the downstream surface 20*b* of the hub is substantially smooth.

It will be appreciated that during rotation of the impeller 18, the fluid drawn in by the impeller flows, in the annular duct V defined by the space located between the outer surface of the hub 20 and the outer shell 30, toward the downstream surface 20*b* of the hub 20.

In accordance with the invention, the suction stage 12 further comprises a diffuser 34 which is arranged between the impeller 18 and the centrifugal wheel 14.

This purpose of the diffuser 34 is to reduce the rotational component of the fluid originating from the impeller 18 before it enters the centrifugal wheel 14, said wheel having an inlet 32 located at the outlet of the diffuser 34.

In order to do this, the diffuser 34 comprises a plurality of diffusion blades 36 protruding from an annular portion 30*a* of the outer shell 30 toward the downstream surface 20*b* of the hub 20, these blades 36 having free ends located on the side opposing the outer shell 30.

It may be seen in the FIGURE that the diffuser 34 surrounds the downstream surface of the hub of the impeller, i.e. the hub 20 of the impeller 18 is integrated into a cavity delimited by the free ends of the blades 36.

In a particularly advantageous manner, each of the blades 36 is shaped in such a way that its free end makes the downstream surface 20*b* of the hub 20 flush, preferably over the entire length of said free end, i.e. such that there nevertheless remains a slight clearance between the free end of each of the blades 36 and the downstream surface 20*b*.

As may be seen in the FIGURE, the annular portion 30*a* of the outer shell 30 has an axial length substantially equal to the axial length of the downstream surface 20*b*, on the one hand, and extends axially so as to converge toward the centrifugal wheel 14, on the other hand.

The space delimited between the downstream surface 20*b* and the annular portion 30*a* therefore defines a converging annular duct for the flow of the fluid, said fluid accordingly being directed toward the centrifugal wheel 14 while drawing closer to the axis A of the pump owing to the convergence of the annular duct.

A benefit of making the fluid enter the centrifugal wheel 14 as close as possible to the axis of rotation of this wheel consists in the fact that the diameter of the centrifugal wheel can advantageously be reduced and the compactness of the pump 10 can therefore be further improved.

It will be appreciated that the present invention advantageously allows the outer shell 30 to be moulded in one piece with the blades 36 of the diffuser 34, and this simplifies production of the pump and improves the reliability thereof.

It will therefore be understood that the suction stage 12 according to the present invention can advantageously consist of two moulded parts, i.e. the outer shell equipped with the blades 36 of the diffuser, on the one hand, and the impeller 18, on the other hand.

The invention claimed is:

1. A pump for liquefied gas comprising:

a suction stage having at least one centrifugal wheel, the suction stage comprising:

a rotational impeller equipped with a hub having a downstream surface extending axially toward the centrifugal wheel, the hub being arranged upstream of the centrifugal wheel, and a diffuser comprising a plurality of blades surrounding the downstream surface, wherein the hub further has a median portion and axial ends, the hub having a greater diameter in its median portion than at its axial ends so that the downstream surface converges toward the centrifugal wheel, wherein the blades of the diffuser have free ends, said blades protruding radially toward said downstream surface of the hub, and wherein the downstream surface and an outer shell of the diffuser radially define an annular duct which allows a drawn-in fluid to pass, the annular duct having a substantially constant radial height over the axial length of the downstream surface.

2. The pump according to claim 1, wherein the diffuser surrounds the downstream surface of the hub of the impeller.

3. The pump according to claim 1, wherein the blades of the diffuser are fixed to the outer shell which converges axially toward an inlet of the centrifugal wheel.

4. The pump according to claim 1, wherein the axial length of the diffuser is substantially equal to the axial length of the downstream surface of the hub of the impeller.

5. The pump according to claim 1, wherein the downstream surface has a radial section which diminishes toward the centrifugal wheel.

6. The pump according to claim 1, wherein the hub further has an upstream surface having an axial length and wherein the outer shell presents a constant diameter along the axial length of the upstream surface.

7. The pump according to claim 1, wherein the hub further includes an upstream surface carrying paddles, and wherein the hub is a one-piece element.

8. A pump for liquefied gas comprising:

a suction stage having at least one centrifugal wheel, the suction stage comprising:

a rotational impeller equipped with a hub having a downstream surface extending axially toward the centrifugal wheel, the hub being arranged upstream of the centrifugal wheel, a diffuser comprising a plurality of blades surrounding the downstream surface wherein the hub further has a median portion and axial ends, the hub having a greater diameter in its median portion than at its axial ends so that the downstream surface converges toward the centrifugal wheel, and an outer shell which surrounds the hub, wherein the blades of the diffuser have free ends, said blades protruding radially toward said downstream surface of the hub and wherein the axial length of the diffuser is substantially equal to the axial length of the downstream surface of the hub of the impeller.

9. The pump according to claim 8, wherein the hub further has an upstream surface having an axial length and wherein the outer shell presents a constant diameter along the axial length of the upstream surface.

10. A pump for liquefied gas comprising:

a suction stage having at least one centrifugal wheel, the suction stage comprising:

a rotational impeller equipped with a hub having a downstream surface extending axially toward the centrifugal wheel, the hub being arranged upstream of the centrifugal wheel, and a diffuser comprising a plurality of blades surrounding the downstream surface wherein the hub further has a median portion and axial ends, the hub having a greater diameter in its median portion than at its axial ends so that the downstream surface converges toward the centrifugal wheel, and an outer shell which surrounds the hub, wherein the blades of the diffuser have free ends, said blades protruding radially toward said downstream surface of the hub, and wherein the hub further has an upstream surface having an axial length and wherein the outer shell presents a constant diameter along the axial length of the upstream surface.

11. The pump according to claim 10, wherein the downstream surface and the outer shell radially define an annular duct which allows a drawn-in fluid to pass, the annular duct having a substantially constant radial height over the axial length of the downstream surface.

* * * * *